United States Patent [19]

Saitoh

[11] 4,395,470

[45] Jul. 26, 1983

[54] PROCESS OF FORMING MAGNETIC LATENT IMAGES

[75] Inventor: Koichi Saitoh, Ebina, Japan

[73] Assignee: Fuji Xerox Co., Ltd., Tokyo, Japan

[21] Appl. No.: 288,876

[22] Filed: Jul. 31, 1981

[30] Foreign Application Priority Data

Aug. 1, 1980 [JP] Japan ..... 55/106192

[51] Int. Cl.[3] ..... G03C 19/00

[52] U.S. Cl. ..... 430/39; 430/945

[58] Field of Search ..... 430/39; 427/47

[56] References Cited

FOREIGN PATENT DOCUMENTS 52-10148 1/1977 Japan ..... 430/39

*Primary Examiner*—Bernard D. Pianalto

*Attorney, Agent, or Firm*—Sughrue, Mion, Zinn, Macpeak and Seas

[57] ABSTRACT

A process of forming magnetic latent images having an improved resolution and using a simple and high-speed mechanism. A magnetic recording body is heated in a pattern of a picture image to be recorded with a thermal pattern input device such as a thermal head array or laser device. The heated magnetic recording body is then brought into contact with a master magnetic body whereby the magnetized pattern on the master magnetic body is thermomagnetically transferred to the magnetic recording body to form a magnetic latent image thereon. The magnetic pattern on the master magnetic body is periodically variable. The master magnetic body has a Curie point equal to or greater than that of the magnetic recording body, preferably at least 50° C. or higher.

10 Claims, 5 Drawing Figures

PROCESS OF FORMING MAGNETIC LATENT IMAGES

BACKGROUND OF THE INVENTION

The present invention relates to a process for forming magnetic latent images with a magnetic copying apparatus. More particularly, the invention relates to a process of forming magnetic latent images by heating a magnetic recording body in the pattern of an image and bringing the magnetic recording body into contact with a master magnetic body having a previously magnetized uniform pattern for thermal and magnetic image transfer.

In a magnetic copying apparatus, a magnetic body is magnetized in the pattern of an image to form a magnetic latent image, which is developed by a magnetic toner composed of a macromolecular resin containing minute magnetic particles which serve as magnetic field-sensitive colored particles. The particles forming the latent image are electrostatically or magnetically transferred to a sheet of paper or the like and fixed with heat and pressure to form a permanent picture image. After the residual magnetic toner has been removed, the magnetic body serving as a magnetic latent image carrier either enters a next development cycle or is demagnetized to eliminate the magnetic latent image for the formation thereon of a next new magnetic latent image to repeat the same process.

In such a process of forming magnetic latent images, it has been customary to position a magnetic head adjacent to the magnetic latent image carrier and supply the magnetic head with a recording current responsive to a picture image signal to magnetize the magnetic latent image carrier.

To form a magnetic latent image fully across the width of the image on the magnetic latent image carrier with the magnetic head, a magnetic recording track having a single or plurality of magnetization printing units is used to effect both successive recording along the direction of movement of the magnetic latent image carrier (main scanning) and traverse scanning (auxiliary scanning) in a direction normal to the direction of movement of the carrier for magnetic recording.

Such a recording process requires a precision drive and control system for maintaining a constant auxiliary scanning line interval and for providing a variety of modes of operation such for example as rapid travel of the magnetic latent image carrier to reduce the scanning time, and slow travel of the carrier for imaging operations such as development and transfer of the image.

An array of multiple magnetic heads has also been proposed which provides magnetic recording tracks arranged fully across the image width which are close enough together to provide a desired resolving power for a reproduced picture image in which one line at a time is recorded as the magnetic latent image carrier moves. With the array of multiple magnetic heads, however, it is necessary to arrange narrow recording tracks about 100 μm wide or less at intervals of about 100 μm to meet the desired image resolution. In addition, the coils provided for each recording track should have a sufficient number of windings to reduce the needed recording current to an acceptable value. As these complicated structures are necessarily small in size, electromagnetic interference between adjacent tracks renders the construction of an array of multiple magnetic heads infeasible.

SUMMARY OF THE INVENTION

It is a primary object of the present invention to eliminate the foregoing conventional difficulties.

It is an object of the present invention to provide a process of forming magnetic latent images more easily and more speedily than prior processes of forming magnetic latent images using a magnetic head.

Another object of the present invention is to provide a magnetic copying process which is highly reliable and has improved reproducibility of solid block areas and improved resolving power by utilizing a simple and high-speed process of forming magnetic latent images.

The present invention utilizes a process of thermomagnetic recording to overcome the problems associated with the magnetic head and provides an improvement in the process of forming magnetic latent images in a magnetic copying apparatus of the conventional process of thermomagnetic recording.

More specifically, the invention provides a process of forming magnetic latent images using a magnetizable magnetic recording body, thermal pattern input means for heating the magnetic recording body in accordance with a picture image to be recorded, and a master magnetic body uniformly magnetized in advance. The process includes the steps of heating the magnetic recording body in a pattern of a picture image to be recorded with the thermal pattern input means and bringing the heated magnetic recording body and the master magnetic body into contact with each other whereby a uniformly magnetized master magnetic body causes a thermomagnetic transfer onto the magnetic recording body to form a magnetic latent image on the magnetic recording body.

The thermal pattern input means may be a thermal head array or a laser heating device. Preferably, the magnetized pattern on the master magnetic body is periodically variable, specifically, periodically variable with a period ranging from 1 to 5 L μm, where L represents one dot length in the direction of heating of the portion of the magnetic recording body which is heated by the thermal pattern input means.

The master magnetic body preferably contains at least one magnetic material selected from among $\gamma$-$Fe_2O_3$, Co-Fe, Co-Ni and ferromagnetic ferrite. The magnetized pattern on the master magnetic body may be either in the form of plane magnetization or vertical magnetization. According to the invention, the master magnetic body has a Curie point substantially equal to or higher than that of the magnetic recording body, preferably by 50° C. or higher.

DESCRIPTION OF THE PREFERRED EMBODIMENTS

Prior to detailed description of the present invention, a thermomagnetic recording process will first be described briefly as it constitutes a central part of the present invention.

Principles of thermally magnetized patterning are described in IEEE TRANSACTION ON MAGNETICS, MAG—Vol. 11, No. 4 (1975), pages 996 through 1017, by A. M. Berkowitz and W. H. Meiklejohn, which refers to the phenomenon of thermal residual magnetization. According to the described process, a ferromagnetic body is heated to its Curie point and then cooled to room temperature while an external magnetic field is applied. When the external magnetic field is removed, residual magnetization close to saturated residual magnetization with a less intensive external magnetic field than that for a process of magnetization using only a magnetic field with no cycle of heating and cooling.

A process of forming magnetic latent image in a magnetic copying apparatus utilizing such thermal residual magnetization normally relies on flash exposure as disclosed in Japanese Published Examined Patent Applications. Nos. 40-25388 and 46-11640. While one of these prior art references utilizes heat absorption of an original to be copied and the other relies on light absorption of a magnetic body in attaining a temperature rise due to flash exposure, both are directed to the generation of thermal residual magnetization by applying an external magnetic field before a temperature rise pattern in the shape of a picture image to be recorded has cooled.

Figure 1:
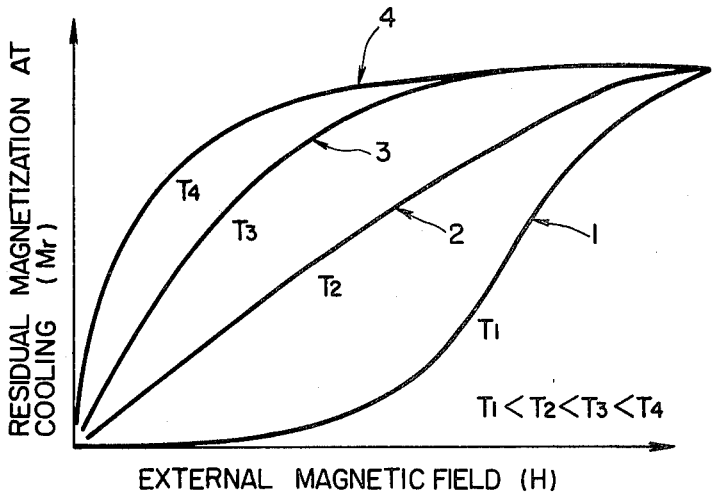
FIG. 1 is a graph explanatory of thermal residual magnetization which is produced when an external magnetic field is applied at temperatures $T_1$, $T_2$, $T_3$ and $T_4$.

As a result of studies by the applicant of the present application, it has been found that a magnetized latent image pattern thus formed cannot meet requirements of optimum image development on a development unit in the magnetic copying apparatus. While the requirements of optimum image development are acceptable, the magnetic latent image is poor, especially with respect to uniformity of the density of a reproduced picture image. This poor density uniformity is considered to be due to the fact that a thermal residual magnetization characteristic is dependent on the temperature of the magnetic body while being cooled at which the external magnetic field is applied. More specifically, as shown in FIG. 1 of the accompanying drawings, the degree of thermal residual magnetization $M_r$ as a function of the external magnetic field H varies as shown at 1, 2, 3 and 4 at different temperatures $T_1$, $T_2$, $T_3$ and $T_4$, respectively, of the magnetic body when the external magnetic field is applied.

Figure 2:
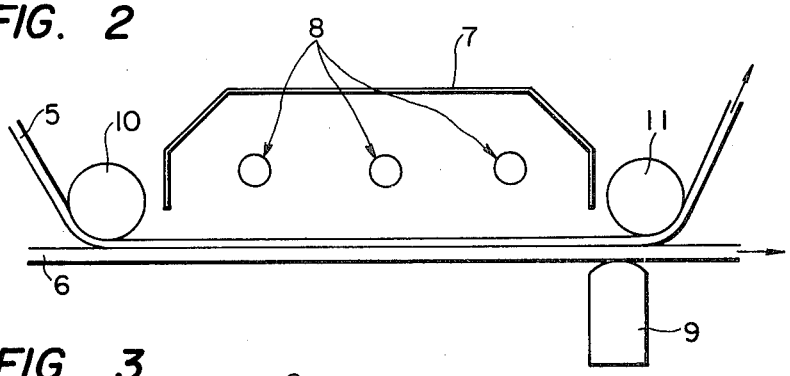
FIG. 2 is a schematic view illustrating a conventional process of forming a magnetic latent image by way of residual magnetization.

Different degrees of residual magnetization result from the different temperatures of the magnetic body for the same external magnetic field. For example, as shown in FIG. 2, an original 5 and a magnetic recording body 6 are held in contact with each other as they are exposed to light from a flash exposure unit including a reflector 7 and flash lamps 8, so that the magnetic recording body 6 is heated in the pattern of an image on the original 5. The magnetic recording body 6 is then subjected to thermal residual magnetization by a magnetic field genertor 9 before the magnetic recording body 6 has cooled. Since the magnetic recording 6 as it travels in the direction of the arrow cools faster at upstream portions than at downstream portions, the upstream portions of the magnetic recording body 6 have a lower temperature while in a magnetic field and hence are subjected to a smaller degree of thermal residual magnetization. The reproduced image therefore has a lower degree of density in the upstream portions.

For uniform thermal residual magnetization in flash exposure, it is preferable to subject a magnetic body to a magnetic field at one time fully over a surface exposed to flash light. To this end, a master magnetic body 14 (FIG. 3) having a uniform magnetic pattern over the entire area thereof is employed in accordance with the present invention instead of the magnetic field generator 9 as illustrated in FIG. 2. The master magnetic body 14 generates a magnetic field which acts on the magnetic recording body 6.

Figure 4:
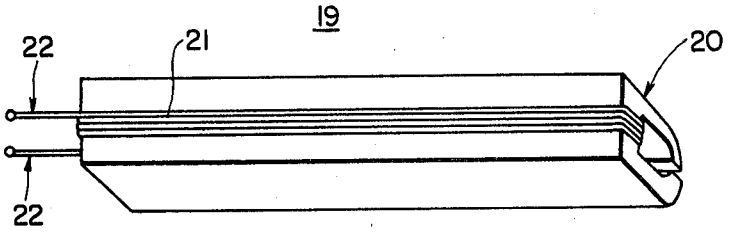
FIG. 4 is a perspective view of a preferred elongated magnetic head used in the present invention.
Figure 5:
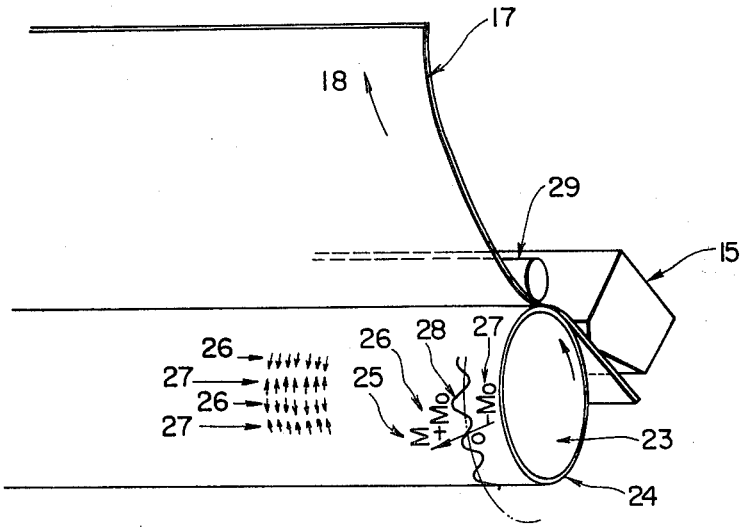
FIG. 5 is a perspective view of another arrangement for carrying out a process of forming a magnetic latent image according to the present invention.

The master magnetic body 14 may be made solely of a magnetic material such as $\gamma$-$Fe_2O_3$, Co-Fe, Co-Ni (which may contain P), or ferromagnetic ferrite (for example, barium ferrite) such as is used on a sound recording tape or a video tape. Further, the magnetic body 14 may be made of a support and a layer of such a magnetic material on the support. The master magnetic body may be in the form of a sheet, a roll or a belt. For example, the master magnetic body may be a roll of $\gamma$-$Fe_2O_3$, a Co-Fe resinous dispersant coated in a Mylar film, or film of an alloy of Co-Ni laminated on a tube of aluminum. The master magnetic body is magnetized by an elongated A.C. magnetic head as shown in FIG. 4 for the formation of a uniformly magnetized pattern. A magnetic field produced by flux leakage should be 10 Oe or higher, or preferably 50 Oe or higher. No magnetic transfer can be effected with a magnetic field below 10 Oe. The magnetic field produced by flux leakage serves as a magnetic force at the surface of the master magnetic body. The uniformly magnetized pattern may be produced by in-plane magnetization (as shown in FIG. 5) or perpendicular magnetization. The master magnetic body preferably has a Curie point which is the same as or higher than the Curie point of the magnetic recording body 6, preferably by 50° C. or more. With the Curie point of the master magnetic body being higher than that of the magnetic recording body, the magnetized pattern on the master magnetic body can be eliminated during thermomagnetic transfer.

Figure 3:
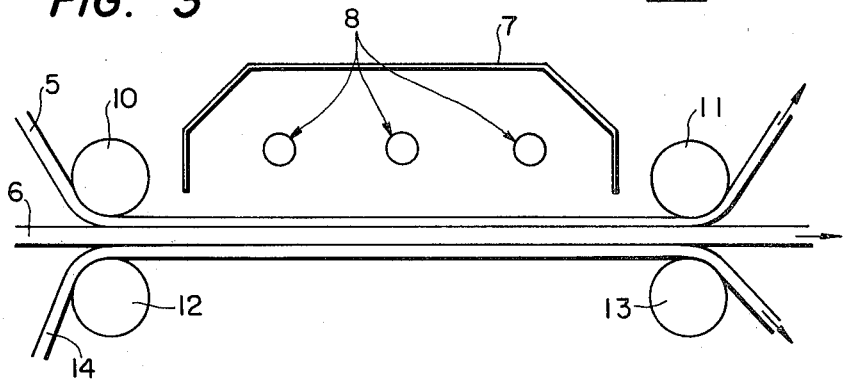
FIG. 3 is a schematic view illustrating a process of forming a magnetic latent image in accordance with the present invention.

The present invention will now be described in detail with reference to FIG. 3. Designated at 5 is an original composed of a transparent support carrying a picture image thereon, 6 a magnetizable magnetic recording body, 7 a reflector, 8 flash lamps for heating the magnetic recording body in the pattern of the picture image, 10, 11, 12 and 13 rollers for bringing together and feeding the original 5, the magnetic recording body 6 and the master magnetic body 14. The magnetic recording body 6 is composed of a magnetic material which has a thermal residual magnetization characteristic, as described above, preferably in a range of high temperatures close to room temperatures. Particularly preferable are a magnetic layer of dispersively coated $CrO_2$ (chromium dioxide) having a Curie point of about 130° C. and an amorphous film of an alloy of a rare earth metal and a transition metal (for example, Tb-Fe, Gd-Fe). The magnetic materials may be coated or laminated on a film of plastics such as Mylar or a nonmagnetic metal.

The original 5, magnetic recording body 6 and master magnetic body 14 are held in intimate contact with each other as they are fed along by the rollers 10 and 12.

When the flash lamps 8 are energized, the original 5 absorbs heat and becomes heated in the pattern of the picture image to accordingly cause the magnetic recording body 6 to be heated in the pattern of the picture image. The magnetic recording body 6 should be heated so that the magnetizable layer thereof may be heated to around the Curie point thereof or higher. The master magnetic body 14 held against the magnetic recording body 6 has over its entire area a uniform magnetic pattern. When the magnetic recording body 6 is heated in the pattern of the picture image, the magnetized pattern on the master magnetic body 14 causes a magnetized pattern to be transferred to and formed on the heated portion of the magnetic recording body 6 by a process known as thermomagnetic transfer. Then, the magnetic recording body 6 is cooled down to around its Curie point, thereby fixing the magnetized pattern on the magnetic recording body 6 which serves as a magnetic latent image corresponding to the picture image on the original 5. The magnetic recording body 6 may be cooled forceably by a stream of air or naturally by increasing the period of time during which the magnetic recording body is held against the master magnetic body 14 after having been heated by the flash lamps 8.

The magnetic recording body 6 having formed thereon the magnetic latent image is fed along by the rollers 11 and 13 and is separated from the original 5 and the master magnetic body 14 for further processing steps for image development and transfer to produce a copy.

The magnetic latent image is developed by a developer and transferred to a material such as a sheet of paper or plastic and then fixed to produce a copied print. When a number of copies are to be duplicated from the same magnetic latent image, the magnetic recording body 6 is cleaned after the developed image has been transferred. The steps of developing, transferring and fixing the image are then repeated until the desired number of copies is contained. Subsequently, the magnetic recording body 6 is cleaned and demagnetized to eliminate the magnetic latent image so as to be readied for copying a new original.

The development may be composed either solely of a magnetic toner, specifically, magnetic powder contained in a resinous binder, or of a mixture of such magnetic toner and a carrier. The magnetic powder in the magnetic toner should be preferably in the range of from 30 to 80 percent by weight of the toner.

The latent image may be developed by a cascade development process, a magnetic brush development process, a touchdown development process, or a powder-cloud development process, but should preferably is developed by the magnetic brush development process since it allows the magnetic toner to be fed at high speeds and enables a magnetic brush to scavenge magnetic toner attached to a background portion of the magnetic recording body for high-speed and high-quality development. The brush development process utilizes a nonmagnetic sleeve and a magnet disposed in the sleeve to form on the sleeve a magnetic brush of the developer which will be brought into contact with or in the vicinity of a magnetic latent image. The magnetic force of the magnet and the distance between the sleeve and the magnetic recording body should be selected not to disturb the magnetic latent image.

The developed image should be transferred to a transfer material preferably electrostatically, magnetically or under pressure.

The toner image may be fixed to the transfer material with heat or pressure. Preferably, the image is fixed with heat by a pair of fuser and pressure rolls. Alternatively, the toner image may be simultaneously transferred and fixed under pressure using a magnetic toner which can be fixed under pressure.

The process of forming the magnetic latent image allows application of a magnetic field which the magnetic recording body is kept uniformly at a constant temperature. Hence, a magnetic latent image of uniform thermal residual magnetization is produced at upstream and downstream portions thereof so that an original can be reproduced with a uniform degree of density.

The flash lamps, or thermal pattern input device, should heat the magnetic recording body to around the Curie point thereof or higher. The magnetic recording body and the master magnetic body should be held in close contact with each other to enable a magnetic field generated by the master magnetic body to act on the magnetic recording body while the latter is cooled down to room temperature, specifically, to around the Curie point or below.

While in the embodiment described above the thermal pattern input device is implemented with flash lamps, it may be a heater head array for use in thermosensitive recording. Such a heater head array includes heater elements and lead wires for supplying an electric current to the heater elements, the heater elements being arranged in a single row or a plurality of rows, 6/mm or 8/mm, substantially perpendicular to the direction of movement of the magnetic recording body. The heater elements are supplied via the lead wires with an electric current dependent on a picture image signal to effect resistance heating.

With the heater head array, scanning recording is simplified. More specifically, the conventional magnetic head suffers from the above-described difficulty in packaging, rendering infeasible the provision of multiple heads for gaining a desired resolution of a reproduced image. The heater head array, however, is simple in structure in that it is composed of resistive elements which are heated when an electric current flows therethrough thus allowing easy fabrication of the array.

An embodiment in which such a heater head array is employed will be described in detail with reference to FIG. 5. Designated at 15 is a heater head array and at 17 a magnetic recording body. The magnetic recording body 17 as it moves in the direction of the arrow 18 is heated by the heater head array 15. While the magnetic recording body 17 is cooling, it is processed by a magnetic field generator composed of a master magnetic roller including a nonmagnetic base roll 23, a master magnetic layer 23 disposed around the base roll 23, and a presser roll 29. The master magnetic roll is driven to rotate at a peripheral speed equal to the speed of travel of the magnetic recording body 17. The master magnetic layer 24 is magnetized to the extent that it generates a magnetic field capable of acting on the magnetic recording body 18. With such a process of thermal residual magnetization, a pattern which is the mirror image of a magnetized pattern on the master magnetic layer 24 is transferred onto the magnetic recording body 17. Hence, it is preferable that the magnetized pattern on the master magnetic layer be a repetitive pattern having a space wavelength as described with reference to FIG. 4. More specifically, the magnetized pattern on the master magnetic layer should preferably be repetitive at a wavelength in a range of from 1 $\mu$m to $5 \times L$ μm, where L represents the length of a portion of the magnetic recording body which is heated with one dot by the heater head. FIG. 7 illustrates schematically such a magnetized pattern. The magnetized pattern is fixed in the axial direction of the roll, but is varied periodically in the circumferential direction of the roll. Magnetization in the circumferential direction may be either parallel or perpendicular to the master magnetic layer. In FIG. 4, however, in-plane magnetization is shown. The periodic pattern is a maximum at 26 and a minimum at 27, and the magnitude of magnetization generally varies as shown by a curve 28.

After the pressure of the roll 29 on the magnetic recording body 17 has been released, a magnetic latent image is formed on the magnetic recording body 17 by the heater head array 15. The magnetic recording body 17 has image areas wherein a magnetized pattern corresponding to the pattern on the magnetic body is formed and non-image areas wherein the magnetic recording body remains unchanged. Stated otherwise, a magnetic latent image is formed in which the image areas are magnetized and non-image areas remains unmagnetized.

A magnetic field generator for producing a uniform magnetic pattern on the master magnetic body should be capable of generating a magnetic field substantially perpendicularly to the direction of travel of the master magnetic body. A preferred form of such a magnetic field generator according to the present invention is an elongated magnetic head as illustrated in FIG. 4. The elongated magnetic head is composed of a magnetic yoke 20 having a width of at least one picture image to be copied and a coil 21 wound around the yoke 20, the coil 21 having terminals 22 and 22 across which an input A.C. signal is applied. The A.C. signal should have a magnitude such that is will generate a magnetic field intensive enough to effect thermal residual magnetization of the magnetic recording body used. The A.C. signal should be of such a frequency that the space wavelength of a magnetized pattern formed on the master magnetic body will in the preferred range. More specifically, the space wavelength of a magnetized pattern should be at least 1 μm or more and five times or less the length in the direction of feeding of a portion of the magnetic recording body which is heated with one dot by the heater head array. For example, where the length of the portion heated per dot by the heater head array is about 100 μm, the frequency of the supplied A.C. signal is selected to cause the space wavelength of the magnetized pattern to be in a range of from 1 μm to 100 μm. It is preferable that the frequency f of the A.C. signal satisfy the relationship $v/5\,L \leqq f \leqq v$, where v is the speed of movement of the magnetic recording body (mm/sec) and L is the length of one dot on the magnetic recording body which is heated by the heater head array.

The thermal pattern input device may be implemented by a mode-locked YAG laser having an energy density of 0.1 ($J/cm^2$) per pulse, or a $CO_2$ laser, an Ar laser, or a high-output He-Ne laser. The magnetic recording body is heated on the $CrO_2$ side by a laser beam applied thereto from a laser oscillator via a modulator supplied with a picture image signal and a scanning mirror.

With the master magnetic body used as the magnetic field generator, no electric input such as an electric current is necessary for generating a magnetic field, and a latent image can be formed at a high speed by thermomagnetic transfer through surface-to-surface contact.

According to the present invention, as described above, a much simpler scanning mechanism is provided than in a conventional magnetic scanning head used for magnetic duplication. Also, a process of forming a magnetic latent image is provided by the invention for a magnetic copying apparatus using a novel master magnetic body which eliminates the problems experienced with a conventional process relaying on a thermomagnetic recoring process.

What is claimed is:

1. A process of forming magnetic latent images using a magnetizable magnetic recording body, thermal pattern input means for heating the magnetic recording body in accordance with a picture image to be recorded, and a master magnetic body uniformly magnetized in advance, said process comprising the steps of:

(a) heating said magnetic recording body to a temperature at least equal to its Curie point in a pattern of a picture image to be recorded with said thermal pattern input means; and (b) bringing the heated magnetic recording body and said master magnetic body into contact with each other wherein said uniformly magnetized master magnetic body causes a thermomagnetic transfer onto said magnetic recording body to form a magnetic latent image on said magnetic recording body corresponding to said pattern of said picture image by thermal residual magnetization.

2. The process according to claim 1, in which said thermal pattern input means comprises a thermal head array.

3. The process according to claim 1, in which said thermal pattern input means comprises means for performing laser heating.

4. The process according to claim 1, in which said magnetized pattern on said master magnetic body is periodically variable.

5. The process according to claim 4, in which said magnetized pattern on said master magnetic body is periodically variable in a period ranging from 1 to $5 \times L$ μm, where L represents one dot length in a direction of feeding of a portion of said magnetic recording body which is heated by the thermal pattern input means.

6. The process according to claim 1, in which said master magnetic body contains at least one magnetic material selected from the group consisting of $\gamma$-$Fe_2O_3$, Co-Fe, Co-Ni and ferromagnetic ferrite.

7. The process according to claim 1, in which said magnetized pattern on said master magnetic body comprises a pattern of in-plane magnetization.

8. The process according to claim 1, in which said magnetized pattern on said master magnetic body comprises a pattern of vertical magnetization.

9. The process according to claim 1, in which said master magnetic body has a Curie point substantially equal to or higher than that of said magnetic recording body.

10. The process according to claim 1, in which said master magnetic body has a Curie point higher than that of said magnetic recording body by 50° C. or higher.

* * * * *